US008941699B2

(12) United States Patent
Gokita et al.

(10) Patent No.: US 8,941,699 B2
(45) Date of Patent: Jan. 27, 2015

(54) FRONT/BACK DISCRIMINATION DEVICE FOR TIME CARD, TIME RECORDER PROVIDED WITH SAME, FRONT/BACK DISCRIMINATION METHOD FOR THE TIME CARD, AND PROGRAM

(75) Inventors: Katsuhisa Gokita, Narashino (JP); Ryuji Okuyama, Narashino (JP)

(73) Assignee: Seiko Precision Inc., Narashino-Shi, Chiba (JP)

( * ) Notice: Subject to any disclaimer, the term of this patent is extended or adjusted under 35 U.S.C. 154(b) by 99 days.

(21) Appl. No.: 13/882,108

(22) PCT Filed: Oct. 12, 2011

(86) PCT No.: PCT/JP2011/073389

§ 371 (c)(1),
(2), (4) Date: Apr. 26, 2013

(87) PCT Pub. No.: WO2012/066870

PCT Pub. Date: May 24, 2012

(65) Prior Publication Data

US 2013/0215162 A1 Aug. 22, 2013

(30) Foreign Application Priority Data

Nov. 17, 2010 (JP) ..... 2010-257165

(51) Int. Cl.
*B41J 17/30* (2006.01)

(52) U.S. Cl.
USPC ..... 346/82; 346/80; 235/377; 235/419

(58) Field of Classification Search
USPC ..... 346/80, 82; 347/40; 235/419, 377; 368/41
See application file for complete search history.

(56) References Cited

U.S. PATENT DOCUMENTS

| | | | | | |
|---|---|---|---|---|---|
| 4,270,043 | A | * | 5/1981 | Baxter et al. | 235/419 |
| 4,394,666 | A | * | 7/1983 | Kato et al. | 346/82 |
| 4,423,314 | A | * | 12/1983 | Kato et al. | 235/377 |
| 2002/0140771 | A1 | * | 10/2002 | Iwaki et al. | 347/40 |

FOREIGN PATENT DOCUMENTS

| | | | |
|---|---|---|---|
| JP | 63-103169 | U | 7/1988 |
| JP | 7-6839 | U | 1/1995 |
| JP | 08-096188 | A | 4/1996 |
| JP | 2005-162422 | A | 6/2005 |
| JP | 2006-285311 | A | 10/2006 |

OTHER PUBLICATIONS

International Search Report (date of mailing Nov. 15, 2011).

* cited by examiner

*Primary Examiner* — Lam S Nguyen
(74) *Attorney, Agent, or Firm* — Howard & Howard Attorneys PLLC

(57) ABSTRACT

A time recorder includes a first sensor that detects the side edge of a time card having a cut-out formed at at least one corner of the bottom, a second sensor that detects the bottom of the time card, and a card feeding unit that feeds the time card. When the time card is fed by this card feeding unit, a pulse counter of the card feeding unit counts the number of pulses of predetermined pulse signals after the first sensor detects the time card and until the second sensor detects the time card. Next, the front and back faces of the time card are determined based on the number of pulses that is a counting result. Hence, the front and back faces can be determined by the first sensor and the second sensor only.

10 Claims, 13 Drawing Sheets

FRONT/BACK DISCRIMINATION DEVICE FOR TIME CARD, TIME RECORDER PROVIDED WITH SAME, FRONT/BACK DISCRIMINATION METHOD FOR THE TIME CARD, AND PROGRAM

CROSS REFERENCE TO RELATED APPLICATION

This application is a national stage application of PCT/JP2011/073389, filed Oct. 12, 2011, which claims priority to Japanese Patent Application No. 2010-257165, filed Nov. 17, 2010, the disclosures of which are hereby incorporated by reference in their entirety.

TECHNICAL FIELD

The present invention relates to a front/back discrimination device for a time card, a time recorder provided with the same, a front/back discrimination method for the time card, and a program.

BACKGROUND ART

In general, time recorders are used for work management of employees in companies or the like. When, for example, coming into work, leaving the work place, or the like, an employee inserts a time card into the slot of the time recorder. Printed on the front face of the time card is a printing field for printing the time for dates from, for example, the 1st day to the 15th day of a given month, and printed on the back face of the time card is a printing field for printing the time for dates on and after the 16th day of that month. The employee inserts the time card into the time recorder with the time card facing up when the day of work is in a date range from the 1st day to the 15th day, and inserts the time card into the time recorder with the time card facing down when the day of work is on and after the 16th day. When the time card is inserted, the time recorder prints on the time card, the time at which the employee comes into work or the time at which the employee leaves the work place.

When, however, the employee inserts the time card with the reversed front and back faces, the time recorder performs printing on the reversed face to the original face intended for printing. In order to prevent this, the following Patent Literature 1 discloses a time recorder which uses a time card having a cut-out formed at one of the four corners, and which includes a sensor unit that detects the proximities of the right and left edges of the inserted time card. This time recorder is capable of detecting whether the cut-out of the time card is located at the right or the left. Accordingly, the front and back faces of the time card can be determined.

Patent Literature 1: Unexamined Japanese Utility Model Application Kokai Publication No. S63-103169.

DISCLOSURE OF THE INVENTION

Problem to be Solved by the Invention

The sensor unit of the time recorder disclosed in Patent Literature 1 includes a sensor element which detects the proximity of the left edge of the time card, a sensor element which detects the proximity of the right side, and a sensor element which is disposed below those respective sensor elements, and which detects whether or not the time card is drawn down to the bottom. Hence, it is necessary for this sensor unit to have at least three sensor elements in total, and thus the configuration becomes relatively complex. Moreover, the manufacturing costs become high. Accordingly, there is a demand for a time recorder or the like which has a simple configuration, and which reduces an increase of the manufacturing costs.

The present invention has been made in view of the above-explained circumstances, and it is an objective of the present invention to provide a front/back discrimination device for a time card with a simple configuration, a time recorder provided with the same, a front/back discrimination method for the time card, and a program.

Means for Solving the Problem

To accomplish the above object, a time card front/back discrimination device according to a first aspect of the present invention is a front/back discrimination device that determines front and back faces of a time card having a cut-out formed at at least one corner of a bottom of the time card, the device including: a first detector that detects a side edge of the time card when the time card is fed into the time card front/back discrimination device; a second detector that detects a bottom of the fed time card; a pulse counter that counts a number of pulses of a predetermined pulse signal after the first detector detects the time card and until the second detector detects the time card; and determining means which detects a presence/absence of the cut-out based on the number of pulses counted by the pulse counter, and which determines the front and back faces of the time card based on the detection of the presence/absence of the cut-out.

The first detector may be disposed at a position near one side of a feeding path of the time card, and overlapping the cut-out of the fed time card, and detects the fed time card, the second detector may be disposed at a position near an end of the feeding path of the time card, not overlapping the cut-out of the fed time card, and near the bottom of the time card over the first detector, and the second detector may detect the time card after the first detector detects the time card.

The time card front/back discrimination device may further include a motor for feeding the time card, in which the pulse signal is a drive pulse for driving the motor.

The time card front/back discrimination device may further include feeding means for feeding the time card, in which the feeding means changes a feeding direction of the time card based on the detection by the second detector.

The time card front/back discrimination device may further include measuring means for measuring a date and a time, in which the pulse signal is generated by the measuring means.

A time recorder according to a second aspect of the present invention includes: the time card front/back discrimination device of the first aspect; and a printing unit that prints a date and a time on the time card based on a determination result by the time card front/back discrimination device.

A time card front/back discrimination method according to a third aspect of the present invention is a front/back discrimination method of determining front and back faces of a time card having a cut-out formed at at least one corner of a bottom of the time card, the method including: a step for detecting a side edge of a fed time card; a step for detecting a bottom of the fed time card; a step for counting a number of pulses of a predetermined pulse signal after the side edge of the time card is detected and until the bottom of the time card is detected; and a step for detecting a presence/absence of the cut-out based on the number of counted pulses, and determining the front and back faces of the time card based on the detection of the presence/absence of the cut-out.

A program according to a fourth aspect of the present invention causes a computer to execute: a process for detecting a side edge of a fed time card; a process for detecting a bottom of the fed time card; a process for counting a number of pulses of a predetermined pulse signal after the side edge of the time card is detected and until the bottom of the time card is detected; and a process for detecting a presence/absence of a cut-out formed at at least one corner of the bottom of the time card based on the number of counted pulses, and determining front and back faces of the time card based on the detection of the presence/absence of the cut-out.

Effects of the Invention

A number of pulses in pulse signals output until the bottom of the time card is counted after the side edge of the time card is detected. Next, the front and back faces of the time card are determined on the basis of the number of pulses that is a counting result. Hence, the determination on the front and back faces can be carried out only by a sensor for detecting the side edge of the time card and a sensor for detecting the bottom of the time card. Accordingly, the device can have a simplified configuration.

MODE FOR CARRYING OUT THE INVENTION

Figure 1:
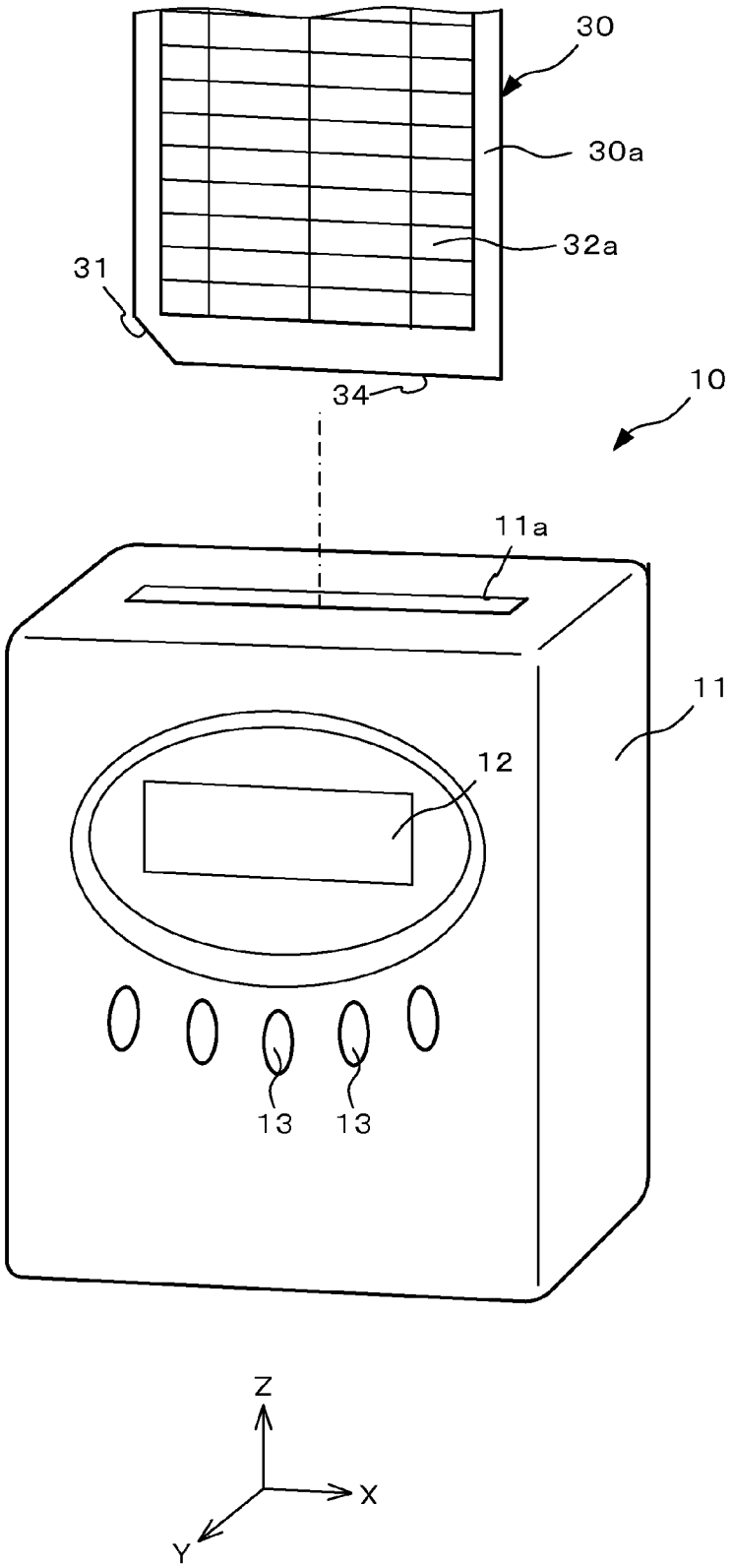
FIG. 1 is a perspective view of a time recorder according to an embodiment.

An explanation will now be given below of a time recorder 10 according to an embodiment of the present invention with reference to the drawings. In order to facilitate understanding, X-Y-Z coordinates are set having an X-axis along the side direction of the time recorder 10, a Y-axis along the front direction of the time recorder 10, and a Z-axis along the vertical direction of the time recorder 10, and are referred as needed.

The time recorder 10 according to the present embodiment is a device that prints the time at which an employee comes into work, the time at which the employee leaves the work place, or the like on a time card 30. This time recorder 10 has a housing 11 as illustrated in FIG. 1.

The housing 11 is a casing in a substantially cuboid shape having a Z direction as a lengthwise direction. This housing 11 is formed of, for example, a resin. Disposed on the front face of the housing 11 are a display screen 12 that displays information to the employee who uses the time recorder 10, and operation keys 13 that receive information from the employee.

Formed on the top face of the housing 11 is a slot 11*a* for inserting the time card 30. When the time card 30 is inserted into the slot 11*a*, the time recorder 10 draws the time card 30 into a feeding path 11*b* illustrated in FIG. 3 and in the housing 11, prints the time and the like on the time card at a predetermined position, and ejects the printed time card 30 from the slot 11*a*.

As illustrated in FIG. 1, the display screen 12 is viewable from the front of the time recorder 10, and displays information like characters and symbols to the employee or the like who uses this time recorder 10. An example display screen 12 is a liquid crystal display.

The operation keys 13 include an arrival key, a departure key, and the like. When, for example, the time at which the employee arrives at work is printed on the time card 30, the employee pushes the arrival key, and inserts the time card 30 into the slot 11*a* of the housing 11. Hence, the time at which the employee arrives at work is printed on the time card 30.

Figure 2:
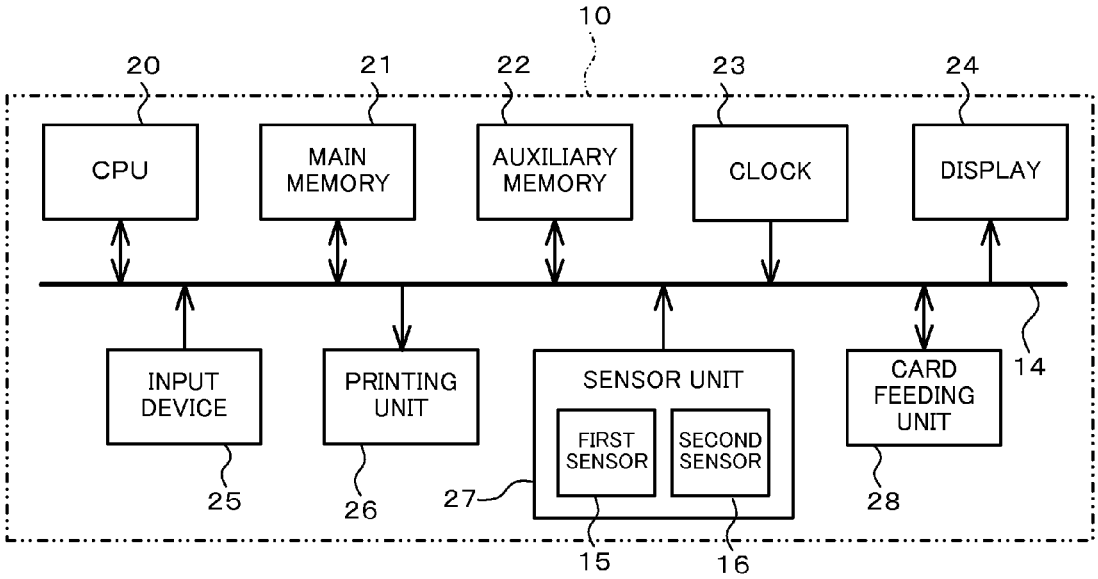
FIG. 2 is a block diagram of the time recorder.

Retained in the housing 11 are, as illustrated in FIG. 2, a CPU (Central Processing Unit) 20, a main memory 21, an auxiliary memory 22, a clock 23, a display 24, an input device 25, a printing unit 26, a sensor unit 27, a card feeding unit 28, a bus 14 that interconnects those respective sections, and the like.

The CPU 20 executes a process for printing the time card 30 in accordance with a program stored in the auxiliary memory 22.

The main memory 21 includes a RAM (Random Access Memory) or the like, and is used as a work area for the CPU 20.

The auxiliary memory 22 includes a non-volatile memory, such as a ROM (Read Only Memory), a magnetic disk, or a semiconductor memory. This auxiliary memory 22 stores a program run by the CPU 20, various kinds of parameters, and the like.

The clock 23 measures the present date and time and notifies the CPU 20 of the measured date and time.

The display 24 includes the above-explained display screen 12, and displays the processing result by the CPU 20. An example display 24 is a liquid crystal display.

The input device 25 includes the above-explained operation keys 13. The input device 25 detects an operation given to the operation key 13, and outputs a signal in accordance with the detection result to the bus 14.

The printing unit 26 prints the date and the time on the time card 30. The printing unit 26 includes, for example, a print head, and an ink ribbon cartridge.

The sensor unit 27 includes a first sensor 15 and a second sensor 16. The first sensor 15 and the second sensor 16 each include a reflective optical sensor element, and output a signal in accordance with the detection result of the time card 30 to the CPU 20 through the bus 14.

Figure 3:
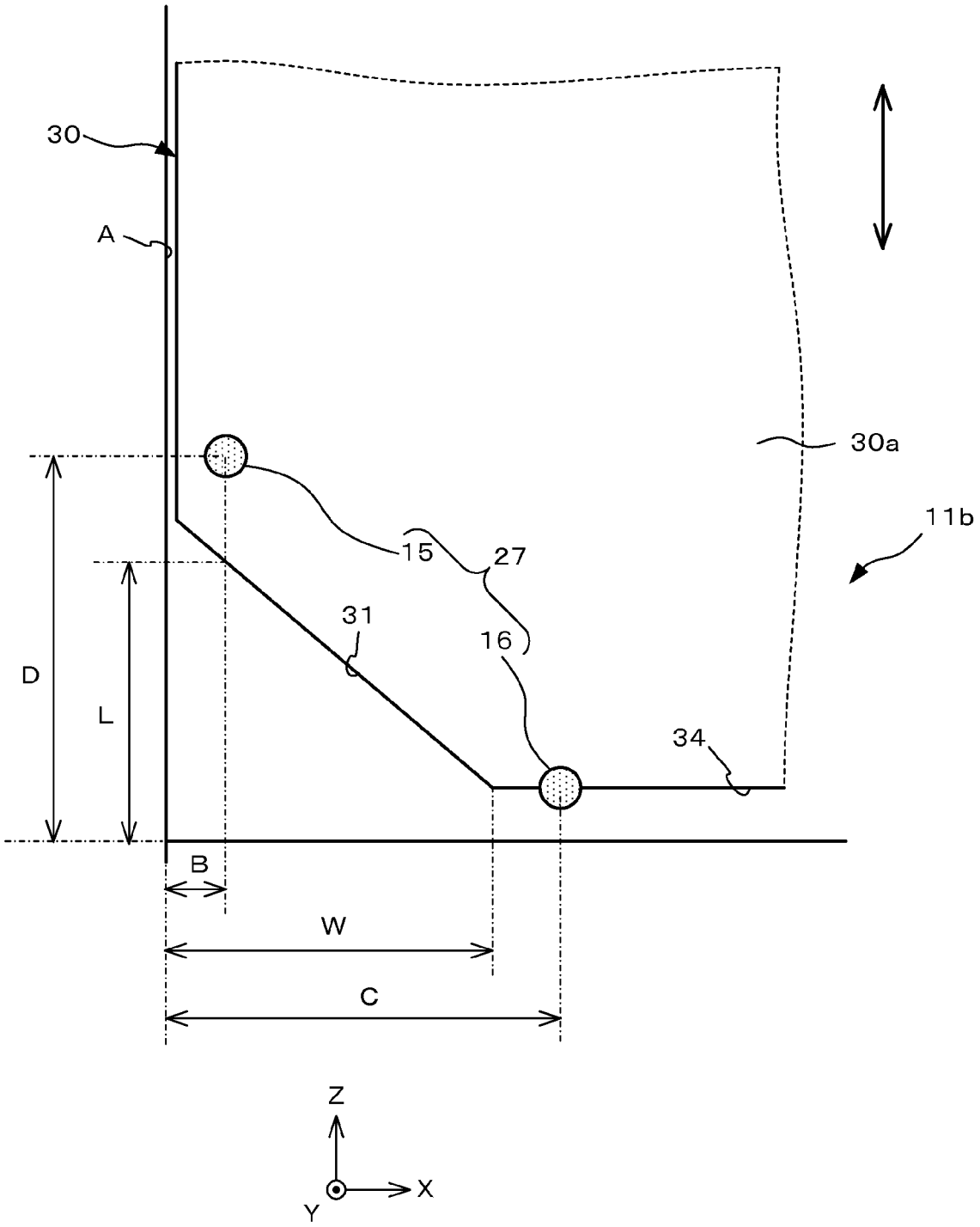
FIG. 3 is a diagram for explaining a disposition relationship between a first sensor, a second sensor and a time card when a time card is drawn to a bottom of the time recorder.

In order to detect the left edge of the inserted time card 30, the first sensor 15 is disposed near a left edge A of the feeding path 11*b* formed in the housing 11 as illustrated in FIG. 3.

The second sensor 16 is disposed near the bottom of the feeding path 11*b*, and detects a bottom 34 of the time card 30 when the time card is fed to the bottom.

Figure 4:
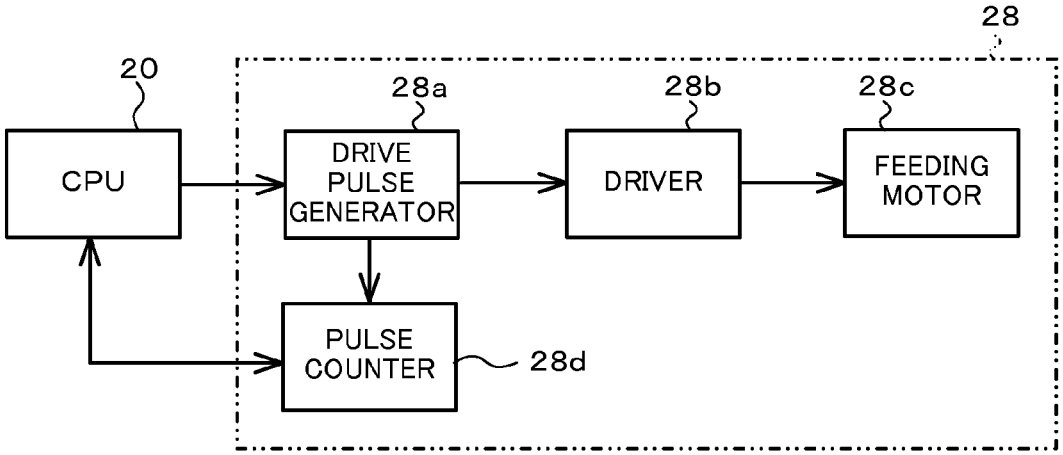
FIG. 4 is a block diagram of a card feeding unit.

The card feeding unit 28 feeds the time card 30 inserted into the slot 11*a* in a +Z direction or in a −Z direction. As illustrated in FIG. 4, this card feeding unit 28 includes, for example, a drive pulse generator 28*a*, a driver 28*b*, a feeding motor 28*c*, a pulse counter 28*d*, and feed rollers.

The drive pulse generator 28*a* includes, for example, a separately-excited signal transmitter circuit, and generates drive pulses in accordance with the speed control by the CPU 20.

The driver 28*b* rotates the feeding motor 28*c* at a predetermined angle in response to a drive pulse signal from the drive pulse generator 28*a*.

The feeding motor 28*c* drives conveyance rollers or the like, thereby feeding the time card 30 inserted into the slot 11*a* of the housing 11 downwardly (−Z direction) through the feeding path 11*b*. Moreover, the feeding motor then feeds the time card 30 fed to a predetermined downward position back upwardly (+Z direction). The feeding motor 28*c* includes, for example, a stepping motor.

The pulse counter 28*d* starts counting the number of pulses in drive pulses output by the drive pulse generator 28*a* in response to a counting start signal from the CPU 20, and terminates the counting in response to a counting termination signal from the CPU 20. When terminating the counting, the pulse counter 28*d* notifies the CPU 20 of the count value of the number of pulses. Moreover, the number of pulses in drive pulses is a value corresponding to the fed amount of the time card 30. Hence, the fed amount of the time card 30 after the counting start signal is output and until the counting termination signal is output can be roughly calculated from the count value of the number of pulses.

Figure 5A:
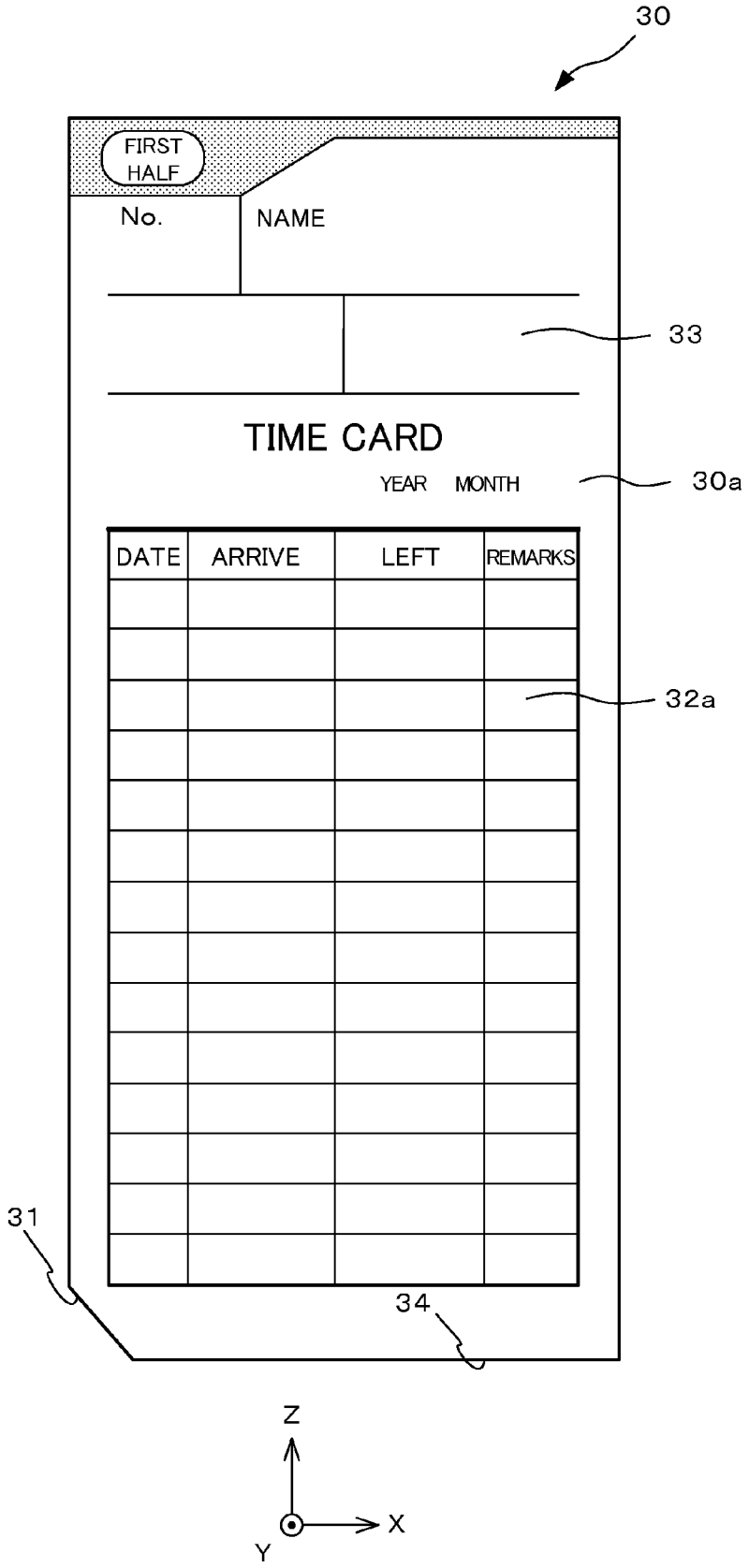
FIG. 5A is a front view of a time card.
Figure 5B:
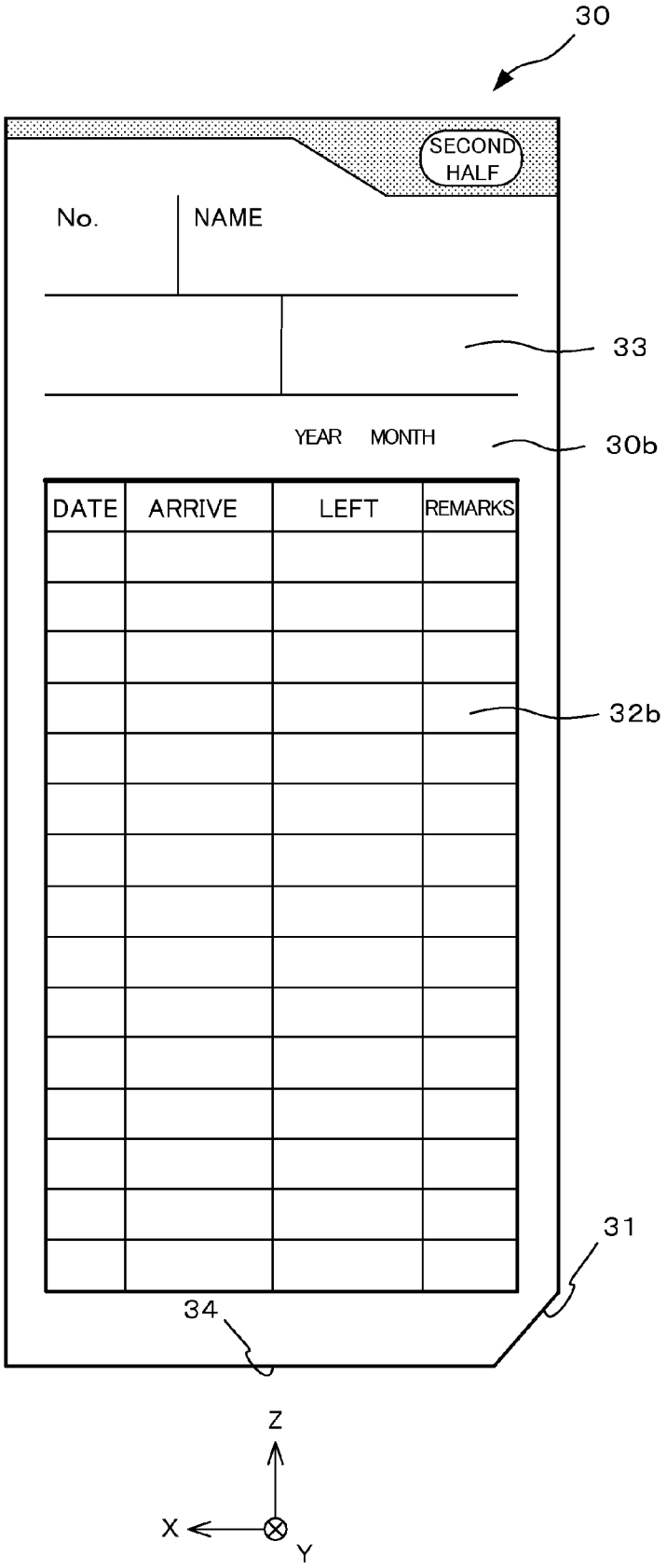
FIG. 5B is a rear view of the time card.

For the above-explained time recorder 10, as illustrated in FIG. 5A and FIG. 5B, a time card 30 is used which has a cut-out 31 formed at one corner of the bottom 34 (edge at the −Z side). An example time card 30 is a cardboard formed in a substantially rectangular shape. Printed on a face 30*a* of the time card 30 and a reversed face 30*b* thereof are time fields 32*a* and 32*b* for printing the date and the time, and a name field 33 in which the name of a user is filled. As illustrated in FIG. 5A, the time field 32*a* on the face 30*a* is a field for listing the time of the day of work in a time range from, for example, the 1st day to the 15th day of a given month. As illustrated in FIG. 5B, the time field 32*b* on the face 30*b* is a field for listing the time of the day of work on and after, for example, the 16th day of that month.

The cut-out 31 is formed by obliquely cutting the corner of the time card 30. As illustrated in FIG. 3, a distance B from the left edge A of the feeding path 11*b* to the first sensor 15 in an X direction is shorter than a dimension W of the cut-out 31 in a horizontal direction (X direction). Moreover, a distance C from the left edge A to the second sensor 16 in the X direction is longer than the dimension W. Accordingly, when the time card 30 is inserted with the face 30*a* facing up, the cut-out 31 passes through the disposed position of the first sensor 15.

When it is presumed that the dimension of the cut-out 31 in the Z direction is L at a position apart from the left edge A in a +X direction by the distance B, the dimension L is shorter than a distance D between the first sensor 15 and the second sensor 16 in the Z direction. Hence, no matter which one of the face 30*a* or the face 30*b* is facing up, the inserted time card 30 first passes through the disposed position of the first sensor 15, and then reaches the disposed position of the second sensor 16.

Next, an action of the above-explained time recorder 10 will be explained with reference to FIG. 1, FIG. 2, FIG. 4, FIG. 6A, FIG. 6B, FIG. 7A, and FIG. 7B.

As illustrated in FIG. 1, when the time card 30 is inserted into the slot 11*a*, the drive pulse generator 28*a* generates drive pulses on the basis of the control by the CPU 20. The driver 28*b* rotates the feeding motor 28*c* at a predetermined speed in response to the drive pulses. The time card 30 is fed downwardly (−Z direction) in the feeding path 11*b* by the rotation of the feeding motor 28*c*.

Figure 6A:
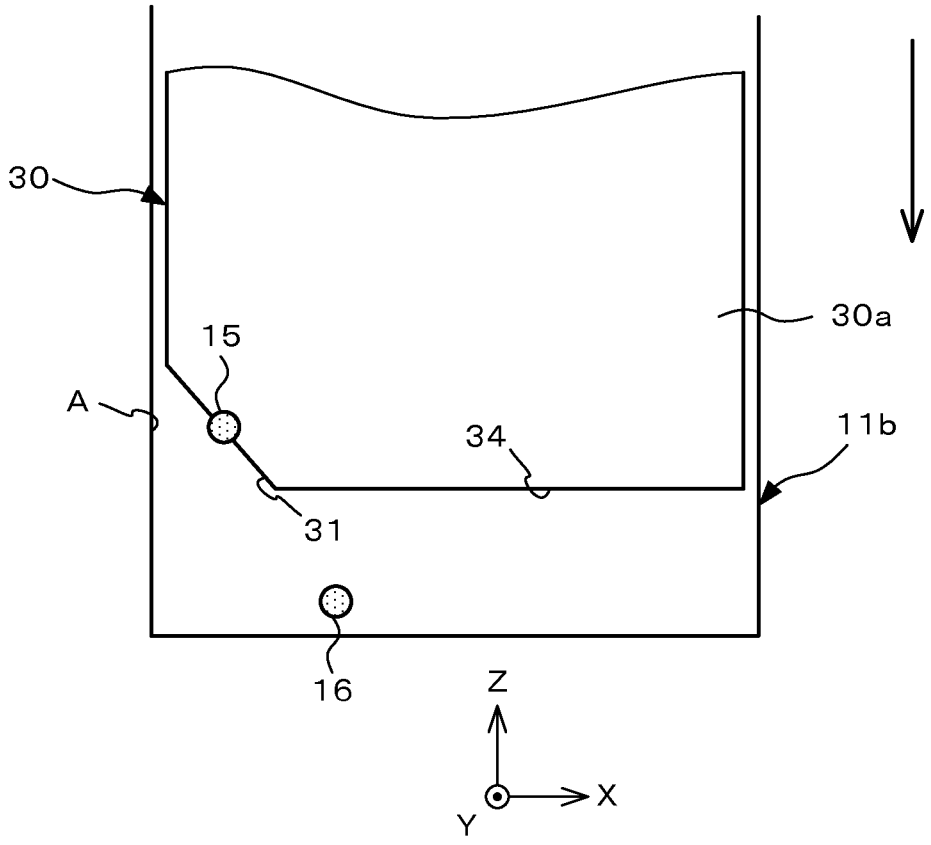
FIG. 6A is a (first) diagram for explaining an action of the time recorder when the time card is inserted in a face-up manner.

When the time card 30 moves downwardly in a face-up manner as illustrated in FIG. 5A (that is, when the face 30*a* faces the front and the cut-out 31 is located at the lower left), first, the first sensor 15 detects the oblique part of the cut-out 31 of the time card 30 as illustrated in FIG. 6A, and outputs a detection signal to the CPU 20 through the bus 14. The CPU 20 outputs the counting start signal to the pulse counter 28*d* in response to the detection signal output by the first sensor 15. This counting start signal causes the pulse counter 28*d* to start counting the drive pulses generated by the drive pulse generator 28*a*.

Figure 6B:
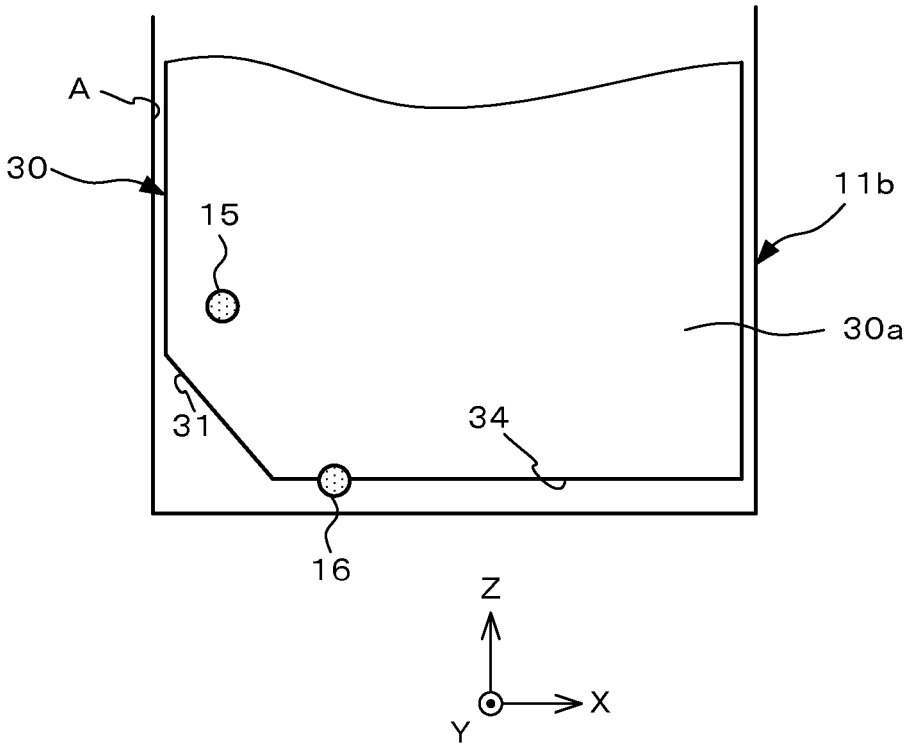
FIG. 6B is a (second) diagram for explaining an action of the time recorder.

When the card feeding unit 28 further moves the time card 30 downwardly, the second sensor 16 detects the bottom 34 of the time card 30 as illustrated in FIG. 6B, and outputs a detection signal to the CPU 20 through the bus 14. The CPU 20 outputs the counting termination signal to the pulse counter 28*d* in response to the detection signal output by the second sensor 16. This counting termination signal causes the pulse counter 28*d* to terminate the counting of the drive pulses, and notifies the CPU 20 of the count value, and the drive pulse generator 28*a* stops generating the drive pulses to stop the rotation of the feeding motor 28*c*.

When the rotation of the feeding motor 28*c* stops, the feeding of the time card 30 also stops. The stop position of the time card 30 at this time is set to be a reference position for printing, and the printing unit 26 performs printing on the time card 30 with reference to this reference position.

Figure 7A:
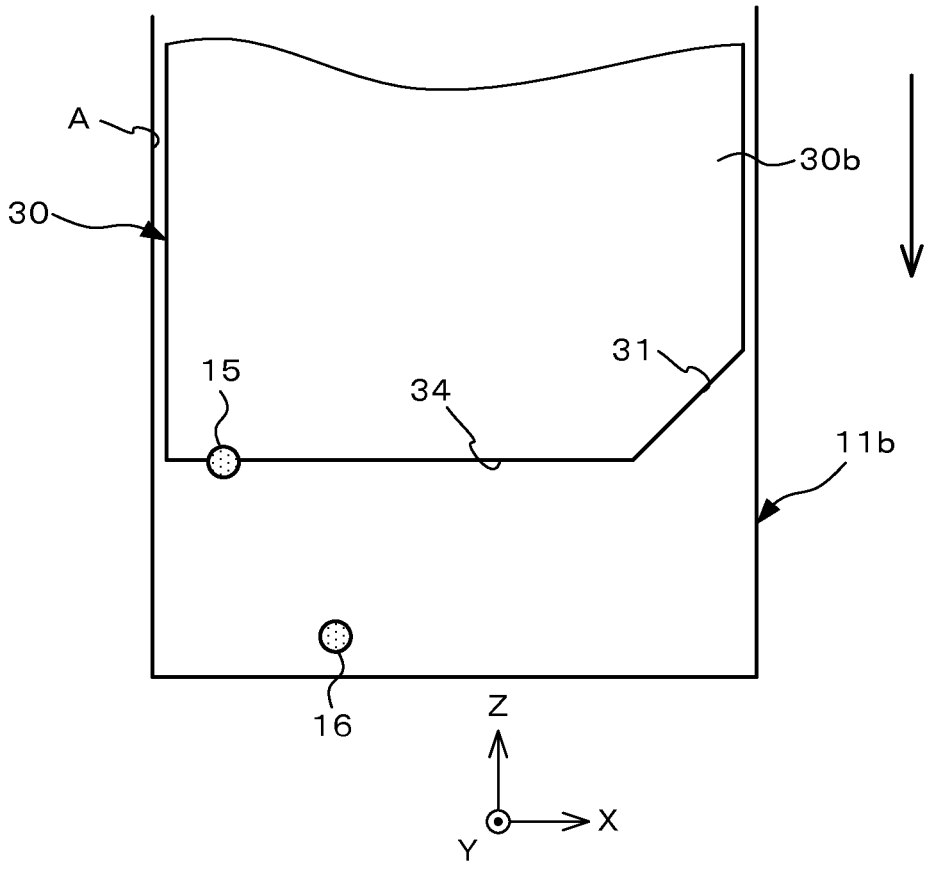
FIG. 7A is a (first) diagram for explaining an action of the time recorder when the time card is inserted in a face-down manner.

Conversely, when the time card 30 moves downwardly in a face-down manner as illustrated in FIG. 5B (that is, when the face 30*b* faces the front and the cut-out 31 is located at the lower right), first, the first sensor 15 detects the bottom 34 of the time card 30 as illustrated in FIG. 7A, and outputs the detection signal to the CPU 20 through the bus 14. The CPU 20 outputs the counting start signal to the pulse counter 28*d* in response to this detection signal, and the pulse counter 28*d* starts counting the drive pulses.

Figure 7B:
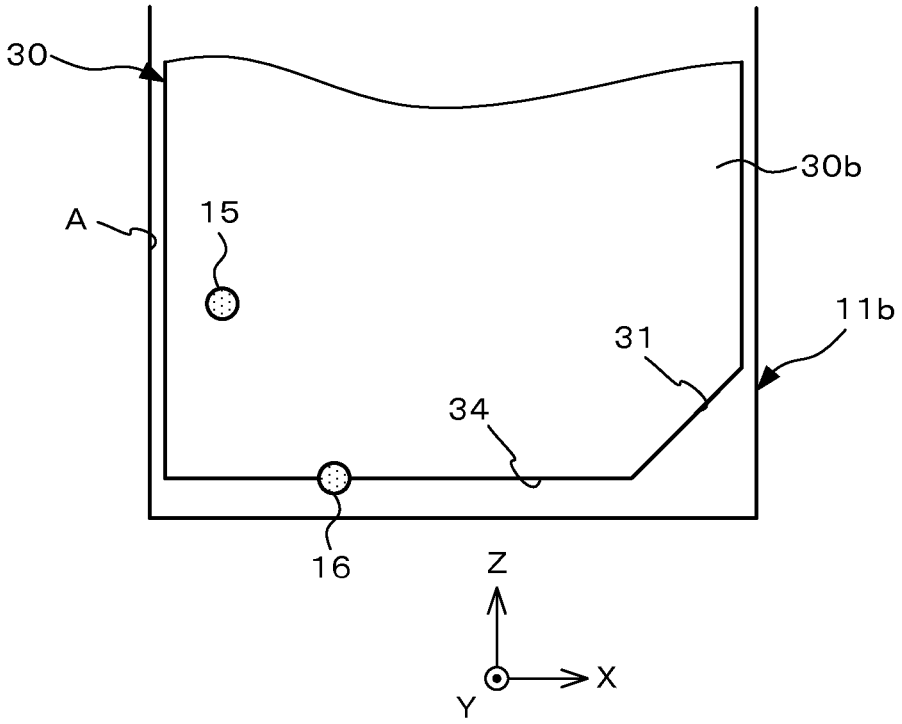
FIG. 7B is a (second) diagram for explaining an action of the time recorder.

When the time card 30 further moves downwardly, the second sensor 16 detects the bottom 34 of the time card 30 as illustrated in FIG. 7B, and outputs the detection signal to the CPU 20. In response to this detection signal, the CPU 20 outputs the counting termination signal to the pulse counter 28*d*. This counting termination signal causes the pulse counter 28*d* to terminate the counting of the drive pulses, and notifies the CPU 20 of the count value, and the drive pulse generator 28*a* stops generating the drive pulses to stop the rotation of the feeding motor 28*c*.

When the rotation of the feeding motor 28*c* stops, the feeding of the time card 30 also stops. The stop position of the time card 30 at this time is set to be the reference position for printing, and the printing unit 26 performs printing on the time card 30 with reference to this reference position.

The CPU 20 determines whether or not the time card 30 has the cut-out 31 at the lower left based on the count value notified from the pulse counter 28*d*. As explained above, the approximate value of the fed amount of the time card 30 after the first sensor 15 detects the time card 30 and until the second sensor 16 detects the time card 30 can be calculated from how large the count value is. Accordingly, when the fed amount is calculated from the count value as the distance D indicated in FIG. 3, the CPU determines that the cut-out 31 is located at not the lower left of the time card 30 but the lower right thereof, and determines that the face 30*b* of the time card 30 faces the front.

Conversely, when the fed amount is calculated from the count value as a distance (D-L), the CPU 20 determines that the cut-out 31 is located at the lower left of the time card 30, and determines that the face 30*a* of the time card 30 faces the front.

The CPU 20 determines whether the face subjected to printing of the time is the face 30*a* or the face 30*b* on the basis of the date notified from the clock 23.

Conversely, the CPU 20 detects that the time card 30 has reached the bottom of the feeding path 11*b* in response to the detection signal from the second sensor 16, and controls the card feeding unit 28 to change the feeding direction of the time card 30 to the upward direction (+Z direction).

When determining that the face to be subjected to printing is consistent with the front face of the inserted time card 30, the CPU 20 feeds the time card 30 from the detection position of the second sensor 16 to a printing position on the basis of the date notified from the clock 23. Next, the CPU 20 controls the printing unit 26 to print the time measured by the clock 23 on the corresponding time field 30*a* or 30*b*. After the printing, the CPU 20 causes the card feeding unit 28 to feed the time card 30 upwardly (+Z direction), and ejects the time card.

Conversely, when determining that the face to be subjected to printing is not consistent with the front face of the inserted time card 30, the CPU 20 outputs, to the display 24, a signal to the effect that the inserted time card 30 is reversed, and the display 24 displays that information on the display screen 12. Moreover, the CPU 20 causes the card feeding unit 28 to feed the time card 30 upwardly (+Z direction) without any printing, and ejects the time card.

As explained above, according to the time recorder 10 of the present embodiment, the pulse counter 28*d* counts the number of pulses in the drive pulses after the first sensor 15 detects the time card 30 and until the second sensor 16 detects the time card 30. Next, it is determined whether the cut-out 31 is located at the right or the left on the basis of how large this count value is, thereby determining the front and back faces of the inserted time card 30. Hence, the determination on the front and back faces of the time card 30 can be performed through only the two sensor elements (first sensor 15 and second sensor 16). Accordingly, the time recorder 10 can have a simplified configuration, and manufacturing cost increases can be curtailed. In addition, the second sensor 16 can be also used as a sensor which detects the reference position of the time card 30.

The embodiment of the present invention was explained above, but the present invention is not limited to the above-explained embodiment or the like.

In the above-explained embodiment, the CPU 20 calculates the fed amount (D or (D-L)) of the time card 30 from the count value, but the present invention is not limited to this case. When it is presumed that a threshold is, for example, L/2, and when the fed amount calculated from the count value is greater than L/2, it can be determined that the face 30*b* of the time card 30 faces the front, and when the fed amount is less than L/2, it can be determined that the face 30*a* of the time card 30 faces the front.

The CPU 20 may determine the directed face of the time card 30 directly from the count value of the pulse counter 28*d*. The CPU 20 may set a threshold PN of the number of pulses in advance, compare the count value of the pulse counter 28*d* with the threshold PN, and when the count value is greater than the threshold PN, determine that the face 30*b* of the time card 30 faces the front, and when the count value is less than the threshold PN, determine that the face 30*a* of the time card 30 faces the front.

The first sensor 15 and the second sensor 16 each include the reflective optical sensor element, but the present invention is not limited to this configuration, and it is fine as long as the sensors be a transmissive optical sensor element or the like capable of detecting the presence or absence of the time card 30. Moreover, the sensors are not limited to an optical sensor, and may be a mechanical switch or the like, such as a micro-switch.

The cut-out 31 is formed by obliquely cutting the corner of the time card 30. The present invention is, however, not limited to this case, and the corner may be cut in a curved manner.

Figure 8A:
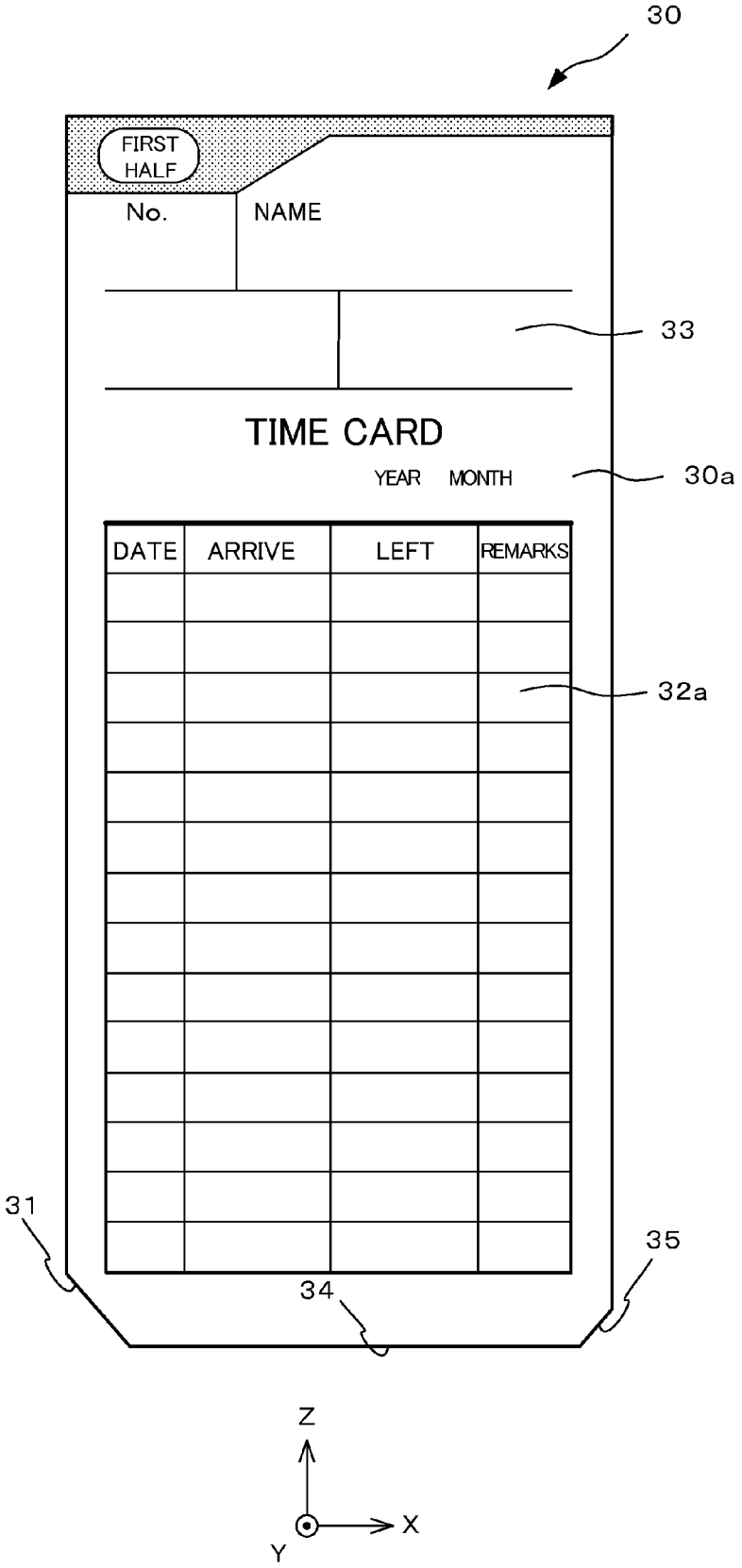
FIG. 8A is a front view illustrating an example modification of a time card.
Figure 8B:
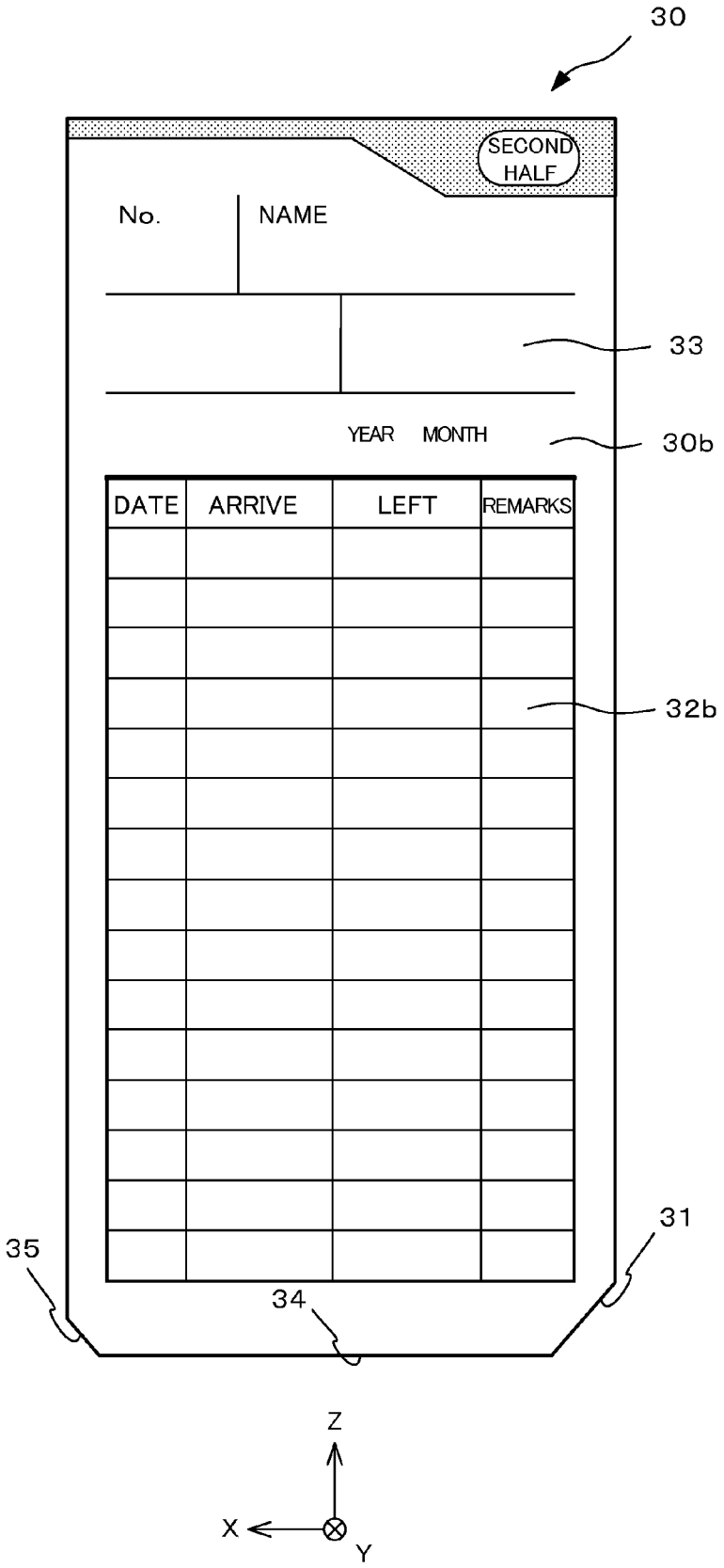
FIG. 8B is a rear view illustrating an example modification of a time card.

Only one cut-out 31 is formed in the time card 30. The present invention is, however, not limited to this structure, and as illustrated in FIGS. 8A and B, cut-outs 31 and 35 with a different dimension may be formed at both sides of the time card 30. According to such a structure, the direction of the time card can be determined such that when the detected fed amount (number of pulses) is greater than a first reference value, the time card is upside down, when the detected fed amount (number of pulses) is less than the first reference value but is greater than a second reference value, the time card is in a condition illustrated in FIG. 8A, and when the detected fed amount (number of pulses) is less than the second reference value, the time card is in a condition illustrated in FIG. 8B.

Cut-outs having respective different dimensions may be formed at the three corners of the time card 30 or the four corners thereof.

The disposed position of the first sensor 15 and that of the second sensor 16 are optional as long as the presence or absence of the cut-out and the size thereof can be detected in such a disposition. The first sensor 15 may be disposed at, for example, the right side of the feeding path 11*b*.

The second sensor 16 may be disposed at a position distant from the bottom of the feeding path 11*b*. In this case, it is necessary to dispose another sensor which detects that the time card 30 reaches the bottom depending on a control scheme.

Figure 9:
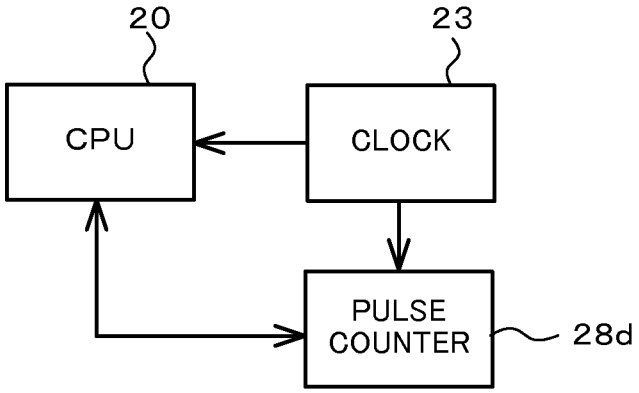
FIG. 9 is a diagram illustrating a configuration of an example modification that counts an internal clock output by a clock.

In the above-explained embodiment, the configuration that causes the pulse counter 28*d* to count the number of pulses in the drive pulses of the feeding motor 28*c* was exemplified, but when a moved amount, a travel time, and a drive amount after the first sensor 15 detects the time card 30 and until the second sensor 16 detects the time card 30 can be measured, the configuration itself is optional. As illustrated in FIG. 9, for example, the number of pulses in the internal clock of the clock 23 may be counted. Moreover, instead of the pulse counter 28*d*, the clock 23 may count the number of the drive pulses, the internal clock, or the like. Furthermore, instead of the pulse counter 28*d*, the CPU 20 itself may count (clock) an operation clock or the like.

A program used in the above-explained embodiment may be stored in a recording medium (a computer-readable recording medium), such as a flexible disk (for example, a magnetic recording disk), a CD-ROM (Compact Disk Read-Only Memory), a DVD (Digital Versatile Disk), or an MO (Magneto-Optical disk) and may be distributable. In this case, the above-explained processes can be executed by installing such program in a predetermined computer. Moreover, the program of the above-explained embodiment may be stored in a memory device (for example, a hard disk) of a server provided over a communication network (for example, the Internet or an intranet), and may be downloaded in a local computer in a manner superimposed on carrier waves. Furthermore, the program may be read from the server, and may be launched and run by the local computer as needed. When some of the functions are borne by an OS (Operating System), only the portions other than the functions borne by the OS may be distributed or transferred.

The present invention can be carried out in various embodiments and be changed and modified in various forms without departing from the broadest spirit and scope of the present invention. The above-explained embodiment is to explain the present invention, and is not to limit the scope of the present invention.

This application is based on Japanese Patent Application No. 2010-257165 filed on Nov. 17, 2010. The entire specification, claims, and drawings of Japanese Patent Application No. 2010-257165 are herein incorporated in this specification by reference.

DESCRIPTION OF REFERENCE NUMERALS

10 Time recorder
11 Housing
11*a* Slot
11*b* Feeding path
12 Display screen
13 Operation key
14 Bus
15 First sensor
16 Second sensor
20 CPU
21 Main memory
22 Auxiliary memory
23 Clock
24 Display
25 Input device
26 Printing unit
27 Sensor unit
28 Card feeding unit
28*a* Drive pulse generator
28*b* Driver
28*c* Feeding motor
28*d* Pulse counter
30 Time card
30*a*, 30*b* Face
31, 35 Cut-out
32*a*, 32*b* Time field
33 Name field
34 Bottom
A Left edge
B, C, D Distance
L, W Dimension

What is claimed is:

1. A time card front/back discrimination device that determines front and back faces of a time card having a first cut-out formed at one corner of an edge of the time card and a second cut-out is formed at the other corner of the edge, where a side length of the time card at which the first cut-out is formed is different from a side length of the time card at which the second cut-out is formed, the device comprising:

a first detector that detects a side edge of the time card when the time card is fed into the time card front/back discrimination device;

a second detector that detects a bottom of the fed time card;

a pulse counter that counts a number of pulses of a predetermined pulse signal after the first detector detects the time card and until the second detector detects the time card; and determining means which detects a side length of the time card at which a cut-out is formed based on the number of pulses counted by the pulse counter, and which determines whether the cut-out is the first cut-out or the second cut-out based on the detection, to determine the front and back faces of the time card.

2. The time card front/back discrimination device according to claim 1, wherein the first detector is disposed at a position near one side of a feeding path of the time card, and overlapping the cut-out of the fed time card, and detects the fed time card, the second detector is disposed at a position near an end of the feeding path of the time card, and is not overlapping the cut-out of the fed time card, and near the bottom of the time card over the first detector, and the second detector detects the time card after the first detector detects the time card.

3. The time card front/back discrimination device according to claim 1, further comprising a motor for feeding the time card, wherein the pulse signal comprises a drive pulse for driving the motor.

4. The time card front/back discrimination device according to any one of claim 1, further comprising feeding means for feeding the time card, wherein the feeding means changes a feeding direction of the time card based on the detection by the second detector.

5. The time card front/back discrimination device according to claim 1, further comprising measuring means for measuring a date and a time, wherein the pulse signal is generated by the measuring means.

6. A time recorder comprising:

the time card front/back discrimination device according to claim 1; and a printing unit that prints a date and a time on the time card based on a determination result by the time card front/back discrimination device.

7. The time card front/back discrimination device according to claim 1, wherein the determining means:

sets a first reference value and a second reference value corresponding to the number of pulses counted by the pulse counter;

determines that, when the number of pulses is greater than the first reference value, the time card is upside down; and determines whether or not the number of pulses is smaller than the first reference value and is greater than the second reference value to determine the front and back faces of the time card.

8. A time recorder comprising: the time card front/back discrimination device according to claim 7; and a printing unit that prints a date and a time on the time card based on a determination result of the time card front/back discrimination device.

9. A time card front/back discrimination method of determining front and back faces of a time card having a first cut-out formed at one corner of an edge of the time card and a second cut-out formed at the other corner of the edge, where a side length of the time card at which the first cut-out is formed is different from a side length of the time card at which the second cut-out is formed, the method comprising:

a step for detecting a side edge of a fed time card;

a step for detecting a bottom of the fed time card;

a step for counting a number of pulses of a predetermined pulse signal after the side edge of the time card is detected and until the bottom of the time card is detected; and a step for detecting a side length of the time card at which a cut-out is formed based on the number of counted pulses, and determining whether the cut-out is the first cut-out or the second cut-out based on the detection to determine the front and back faces of the time card.

10. A program that causes a computer to execute:

a process for detecting a side edge of a fed time card;

a process for detecting a bottom of the fed time card;

a process for counting a number of pulses of a predetermined pulse signal after the side edge of the time card is detected and until the bottom of the time card is detected; and a process for detecting a side length of the time card at which a cut-out is formed, having a first cut-out formed at one corner of an edge of the time card and a second cut-out formed at the other corner of the edge, where a side length of the time card at which the first cut-out is formed is different from a side length of the time card at which the second cut-out is formed, based on the number of counted pulses, and determining whether the cut-out is the first cut-out or the second cut-out to determine front and back faces of the time card based on the detection.

* * * * *